US005367894A

United States Patent [19]

Parks et al.

[11] Patent Number: 5,367,894

[45] Date of Patent: Nov. 29, 1994

[54] APPARATUS AND METHOD FOR WASHING CELLULOSIC PULP

[75] Inventors: Clinton R. Parks, Hamilton; Michael A. Sieron, Centerville; Peter Seifert; David E. Chupka, both of Middletown, all of Ohio

[73] Assignee: The Black Clawson Company, Middletown, Ohio

[21] Appl. No.: 53,729

[22] Filed: Apr. 27, 1993

Related U.S. Application Data

[63] Continuation of Ser. No. 787,578, Nov. 4, 1991, abandoned.

[51] Int. Cl.[5] ..... D21C 9/02

[52] U.S. Cl. ..... 68/22.00 R; 162/60; 162/61; 68/158

[58] Field of Search ..... 162/60, 61; 68/181 R, 68/158, 22 R; 100/37, 158 R, 112, 118, 152; 8/156; 210/386, 109, 770, 783

[56] References Cited

U.S. PATENT DOCUMENTS

| | | | |
|---|---|---|---|
| 1,539,338 | 5/1925 | Wagner | 100/118 |
| 1,778,840 | 1/1931 | Manties | 162/301 |
| 2,356,285 | 8/1944 | Street | 68/22 |
| 2,730,933 | 1/1956 | Reynolds | 210/386 |
| 2,783,689 | 3/1957 | Skoldkuist | 162/358 |
| 2,846,862 | 8/1958 | Morrill | 68/181 R |
| 2,987,988 | 6/1961 | Robledano | 100/118 |
| 3,098,788 | 7/1963 | Hornbostel, Jr. | 162/358 |
| 3,185,617 | 5/1965 | Justus | 162/358 |
| 3,199,317 | 8/1965 | Walsh | 68/158 |
| 3,381,607 | 5/1968 | Clark | 162/358 |
| 4,154,644 | 5/1979 | Ericsson | 162/60 |
| 4,324,659 | 4/1982 | Titoff | 210/386 |
| 5,238,501 | 8/1993 | Kappel et al. | 8/156 |

OTHER PUBLICATIONS

Chemi-Washer Bulletin No. 66-SBB, May, 1988.

*Primary Examiner*—W. Gary Jones
*Assistant Examiner*—Brenda Adele Lamb
*Attorney, Agent, or Firm*—Biebel & French

[57] ABSTRACT

A flat bed, Fourdrinier-type, countercurrent washer for cellulosic pulp incorporates a pressing section at the downstream end thereof which includes the couch roll and additional rolls that carry out multiple mechanical pressing operations on the pulp after it has been subjected to multiple stages of displacement washing without mechanical treatment. As a result, where such washers without mechanical pressing deliver pulp of a consistency of the order of 15% solids, this washer increases the pulp consistency to as high as 40% while correspondingly increasing the effectiveness of the washing operation as a whole.

8 Claims, 3 Drawing Sheets

APPARATUS AND METHOD FOR WASHING CELLULOSIC PULP

CROSS-REFERENCE TO RELATED APPLICATION

This application is a continuation of U.S. patent application Ser. No. 07/787,578, filed Nov. 4, 1991, now abandoned and assigned to the same assignee as this application.

BACKGROUND OF THE INVENTION

In the preparation of cellulosic pulp for use in the manufacture of paper, a common process includes the digesting of wood chips in pulping liquor to break down the pulp into individual fibers and bunches of fibers by dissolving the substances, such as lignins, which bind the fibers together. The spent pulping liquor will therefore contain such dissolved substances and spent chemicals, and the next stage in the preparation of the pulp is a washing stage for the purpose of separating the fibers from the liquor, and also of recovering whatever products of value remain in the liquor.

The art has proposed a variety of types of washers for use in this stage of the preparation of paper making fiber. One type of such apparatus is a flat bed washer which is generally similar in construction and mode of operation to a Fourdrinier paper machine, in that it incorporates an endless foraminous belt ("wire"), a headbox which delivers the pulp suspension in liquor to one end of the horizontally traveling upper run of the wire, successive washing zones along the length of this run, and means at the downstream end of the run for receiving and removing the resulting washed pulp. Pulp washers of this type manufactured by the assignee of the present invention in accordance with Ericsson U.S. Pat. No. 4,154,644 of 1979 have been notably successful, and the present invention was developed to improve the operation and results obtained by such pulp washers.

In the operation of a pulp washer of the Ericsson patent type, the suspension of digested pulp from the digesting system is diluted to a sufficiently low consistency, e.g. 1.5 to 3%, and deposited on the upstream end of the wire run where a mat is formed as the liquid drains through the wire and is recycled to dilute more of the suspension to be washed. Commonly the solids content of this mat is of the order of 8 to 10% at the end of the initial drainage step.

The remainder of the wire run downstream from the mat-formation zone is divided into a series of washing zones to which washing liquid is supplied from above for drainage through the mat and the wire. Fresh washing liquid is supplied to the last of these washing zones, at the downstream end of the wire run, the liquid drained from that last zone is collected and delivered to the washing zone immediately upstream from the final zone, and these steps are repeated for each of the other zones to effect countercurrent washing of the pulp mat as it progresses from the formation zone to the discharge end of the washer, while the filtrate from the first washing zone may be sent to an evaporator station for removing of its dissolved constituents.

The operation of a pulp washer of this type may therefore be described as being according to the displacement washing principle. That is to say, once the pulp mat has been formed, it is not rediluted but simply is subjected to repeated washings by application on top of the mat of washing liquid with the liquid applied in each washing zone having a lower concentration of liquor than the filtrate from the preceding zone. The liquid applied in each zone enters the mat substantially en masse and thereby displaces the liquid which was carried into the zone in the mat and causes it to drain therefrom through the wire.

Among the mechanical elements of a washer according to the Ericsson patent is a hood which encloses the entire apparatus downstream from the headbox, and a series of receptacles below the operating run of the wire and in sealed relation with this hood. In operation, vacuum is applied to these receptacles, and/or gas pressure is developed within the hood, to augment the action of gravity in forcing the washing liquid through the pulp mat on the wire, and one of the features disclosed in the Ericsson patent in the recycling of gases and vapors drawn through the wire into the upper spaces in the receptacles back to the hood to increase the pressure differential above and below the wire.

SUMMARY OF THE INVENTION

In accordance with the present invention, it has been determined that the effectiveness of a pulp washer constructed in accordance with the Ericsson patent can be greatly increased if the downstream end of the washer is extended beyond the last washing zone and provided with a press section comprising at least two pairs of press rolls which will compress the mat and thereby express therefrom so much of the liquid remaining therein as to increase its consistency to as high as 40% solids. As a result, the mat is maintained free of mechanical pressure throughout its travel through the successive washing zones, in order to increase the effectiveness of the displacement washing operations by maintaining the mat as loose as possible. But when it is then subjected to mechanical pressing before being removed from the washer, the resulting removal of most of the liquid remaining therein has been found very effective in producing a cleaner pulp.

Specific means for accomplishing these results are described hereinafter in connection with the accompanying drawings.

DESCRIPTION OF THE PREFERRED EMBODIMENTS

Figure 1:
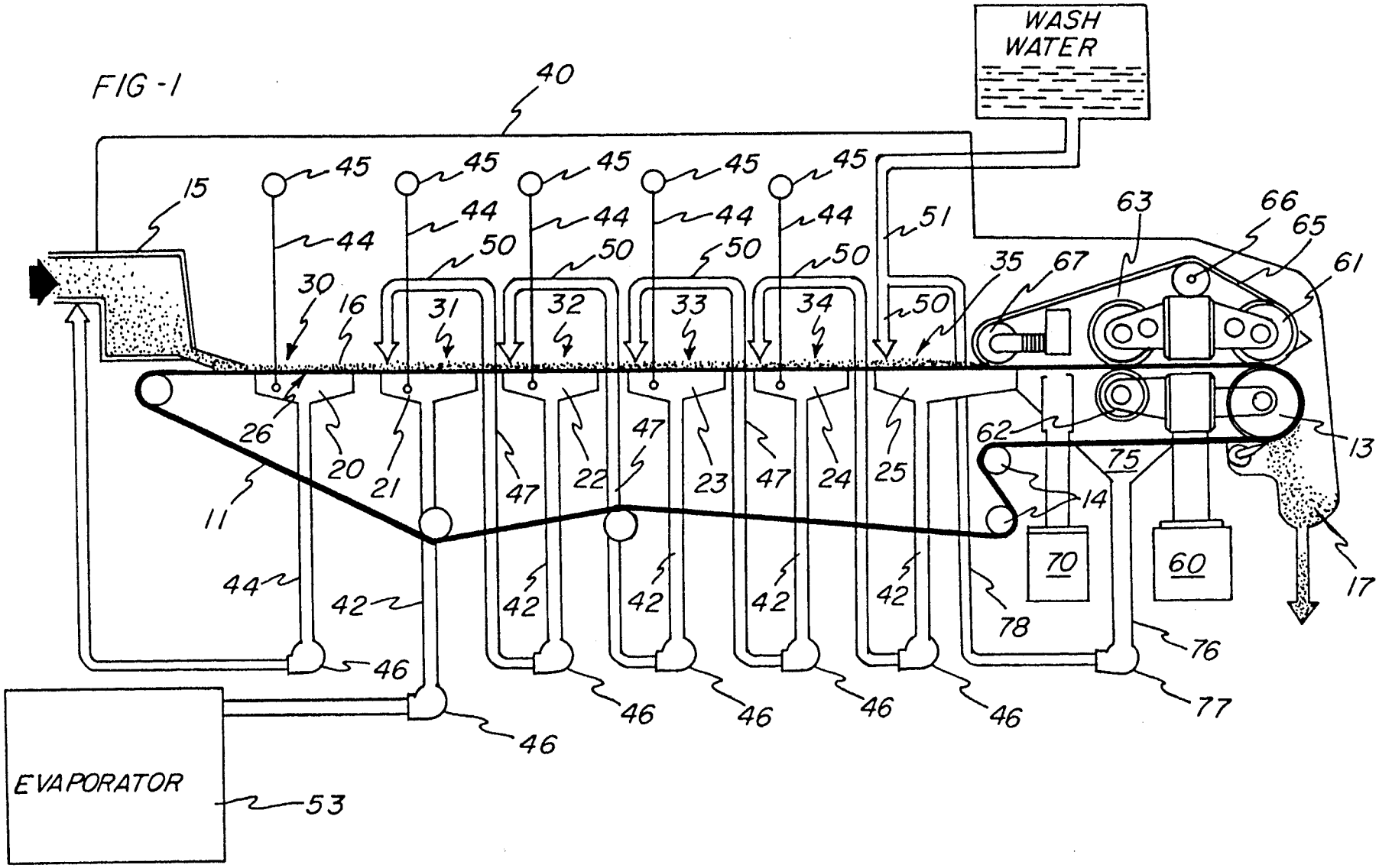
FIG. 1 is a schematic view in side elevation illustrating pulp washing apparatus constructed to operate in accordance with the invention.

In the drawings, a frame indicated generally at 10 supports an endless foraminous belt 11, usually a "wire" mesh of woven plastic filaments, in a loop including a substantially horizontal upper run on a breast roll 12 at the upstream end of the upper wire run, a couch roll 13 at the downstream end of the run, which commonly is the main drive roll for the belt 11 and return and tensioning rolls 14. A headbox 15 deposits the pulp suspension to be washed on the upstream end of the wire run, and as this liquid drains through the wire, a mat 16 of pulp is formed on the wire. This mat passes through a series of washing zones, and the washed pulp mat 16 is discharged from the downstream end of the wire run into any suitable collector 17 from which it is conveyed to the next station in the stock preparation system.

Mounted on the frame 10 immediately below the upper run of wire 11 is a series of receptacles 20–25, each of which is in effect a suction box having a perforate cover 26 of low friction material that supports the portion of the wire run passing thereover. The receptacles 20–25 are connected and operated so that they define a series of successive zones along the path of the belt run comprising a formation zone 30 adjacent the headbox 15 and consecutive washing zones 31–35, the last of which is adjacent the downstream end of the wire run.

A hood 40 is supported by the frame 10 in enclosing relation with all of the zones 30–35, and with the sides thereof in effectively sealed relation with the covers of the receptacles 20–25 outside their perforate portions. Each of the receptacles is connected with a depending pipe 42 which receives liquid accumulating in the receptacle. As is explained in the above Ericsson patent, the level of liquid in each of receptacles 20–25 is controlled to provide space between the liquid and the wire for gases and vapors, and a pipe 44 leads upwardly from this space to a vacuum system, represented by a blower 45, which applies suction to this space to drain liquid through the mat 16 and the wire into each of the receptacles 20–25 while recirculating gases which accumulate in this space to the interior of the hood 40 above the wire 11.

Each of the receptacles 20–25 may, and usually does, comprise a plurality of individual suction boxes coupled to act together, but, for simplicity and clarity, they are represented by single receptacles in FIG. 1. The liquid drain line 44 from each of the receptacles 22–25 leads to a pump 46 from which a discharge line 47 leads to a liquid discharge system, represented by a shower pipe 50, above the upstream end of the adjacent washing zone on the upstream side thereof. Thus the discharge line 47 from the last washing zone 35 leads to zone 34, and so forth.

Within each individual washing zone, since the washing liquid is supplied to the upstream end of the zone, displacement dewatering proceeds as the pulp mat travels through the remainder of the zone. The washing action will be progressive so that at any given instant, the mat within a given washing zone will vary in cleanliness from a minimum adjacent the wire belt 11 to a maximum at the top of the mat, but that clean layer at the top will substantially match in cleanliness the pulp adjacent the wire belt at the bottom of the next zone downstream therefrom, and so forth. In other words, the washing action could be plotted as defining a gradient directed downwardly in the direction of travel of the mat.

At the downstream end of the apparatus, the shower 50 for the final washing zone 35 is supplied with fresh wash liquid by a line 51 from any suitable source 52 such, for example, as white water from a pulp or paper machine elsewhere in the mill. The filtrate drained through receptacle 25 will therefore have the lowest concentration of liquor, and with the piping providing for countercurrent washing, the filtrate from washing zone 31 will have the highest concentration of liquor.

The discharge line 47 from receptacle 21 should therefore preferably lead to the usual evaporator 53. The filtrate from the forming zone 30 will be undiluted liquor, and it is therefore piped back to the inlet side of the headbox 15 to dilute the incoming suspension to be washed. It is also a common practice to combine the filtrates from the formation and first washing zones, and to send to the evaporator only that portion of the combined filtrates which is not needed for dilution purposes at the headbox.

As described up to this point, the construction and mode of operation of the washing apparatus in FIG. 1 are the same as washers marketed by the assignee of this invention under the Ericsson patent, the disclosure of which is incorporated herein by reference. The present invention provides improvements in structure and mode of operation which enhance the effectiveness of the Ericsson patent washers.

As will be understood from the foregoing description, while the consistency of the mat 16 will vary in each washing zone from a maximum at the upstream end of the zone to a minimum as the mat passes into the next downstream zone, it is desirable to maintain the minimum consistency in the neighborhood of 15%, in order minimize the possibility of the development of foam as a result of the entry of gases into the mat. For further explanation of the mode of operation of such washers, reference is made to the co-owned application of Peter Seifert, U.S. patent application Ser. No. 649,103, filed Feb. 1, 1991, the disclosure of which is incorporated herein by reference.

The consistency of the mat 16 as it leaves the most downstream washing zone 35 is therefore relatively low, usually about 15%, but it is at this position on the machine that the pulp is the cleanest. In accordance with the present invention, this relatively clean pulp is subjected to mechanical pressing before leaving the wire 11 in order to express therefrom the major part of the liquid still remaining therein, along with whatever contaminants that liquid will take with it.

In the form of the apparatus of the invention as shown in more detail in FIG. 2, a frame 60 is positioned between the last washing zone 35 and the couch roll 13, and this frame supports a top press roll 61 above the couch roll 13 and an additional pair of press rolls 62 and 63 which are respectively below and above the top run of the wire 11. A top belt loop 65, usually of plastic wire mesh, encloses the rolls 61 and 62, and it is provided with a guide roll 66 at the top of frame 60 and a stretch roll 67 supported on a supplemental frame 70 upstream from the frame 60 by a mounting which includes a variable pressure air bag or bellows 71 for varying the tension of wire.

The purpose of the wire 65 is to prevent the thickened pulp mat 16 from adhering to any of the upper rolls 61, 63 and 67. The wire 65 is preferably of a finer mesh than the wire belt 11 so that the thickened fiber mat 16 will transfer thereto from the wire belt 11 as the two wires separate around the rolls 13 and 61, and the mat is then readily removed from the wire 65 by a suitable doctor 72 which will deflect the mat material into the collector 17. If any pulp should remain on the wire 11, it can be similarly removed by a doctor blade 73 positioned below roll 13.

Preferably, the receptacle 25 is extended downstream to underlie the stretch roll 67 in order to receive any liquid which may be expressed through the wire 11 as it passes under roll 65. An additional receptacle 75 is positioned to receive liquid expressed from the pulp mat as it enters the nip of rolls 62 and 63, and this liquid is conducted by a line 76, pump 77 and line 78 with the line 51 which delivers fresh water to the final washing zone 35.

Provision is also made for delivering to receptacle 75 the liquid expressed onto the upper surface of the pulp mat at the nips of rolls 13–61 and 62–63. For this purpose, a deflector scoop 80 is pivotally mounted on frame structure above the belt 11 and just upstream from the nip of each of these pairs of rolls. Each of these scoops 80 is of a trough shape and may be slightly inclined toward the back of the machine to receive liquid from the nip of the associated rolls and to deliver that liquid laterally through the outside of the machine where it can be dumped into the receptacle 75. In addition, the couch roll 13 and the lower press roll 61 are shown as provided with doctors 81 of a trough shape which will remove liquid from the surfaces of these rolls and similarly deliver it to the back of the machine and then into the receptacle 75.

Figure 2:
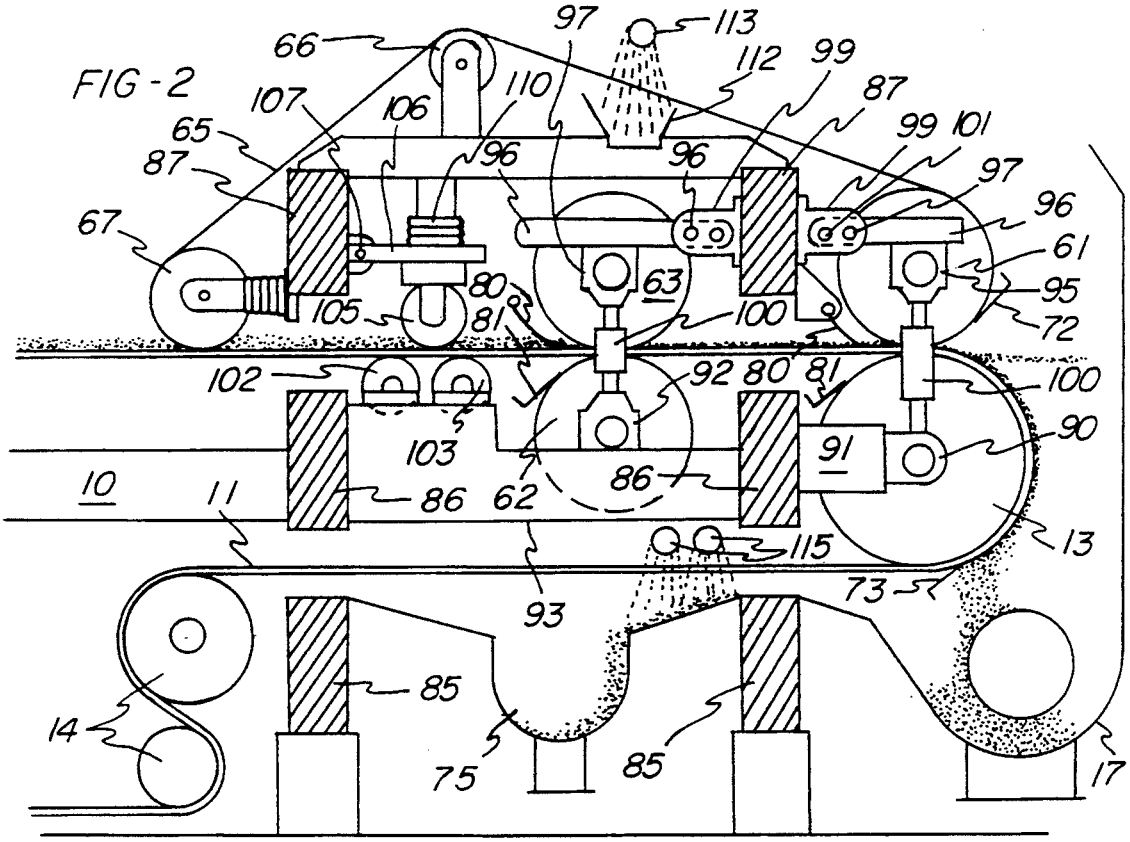
FIG. 2 is a partial view on a larger scale of the downstream end and pressing section of the apparatus shown in FIG. 1.
Figure 3:
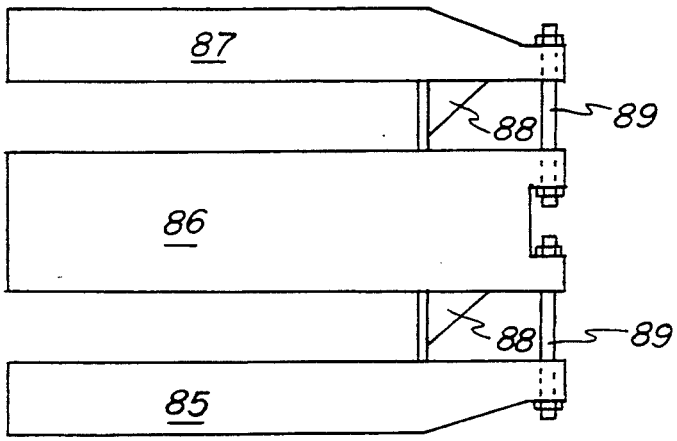
FIG. 3 is a view looking from right to left in FIG. 2 which shows only the framework for supporting the operating parts shown in FIG. 2.

FIGS. 2–3 illustrate in greater detail one form of the press section shown diagrammatically in FIG. 1. Referring first to FIG. 3, for convenience in connection with the changing of belts 11 and 65, each of the frames 60 and 70 is of an E-frame construction comprising a base beam 85 and a pair of cantilevered beams 86 and 87 secured to each other in vertically spaced relation at 88 at the back side of the apparatus. Extensions of beams 86 and 87 beyond structure 88 are connected together and to a similar extension on beam 85 by adjusting means, shown as bolts and nuts 89. At the front side of the machine, the spaces between adjacent beams receive the usual removable blocks, not shown, except when such blocks are removed for the purpose of changing either of wires 11 and 65.

As shown in FIG. 2, the couch roll 13 is provided with bearing housings 90 each of which is mounted on an arm 91 having a fixed mounting on the adjacent end of the associated beam 81. The other roll 62 inside the loop of belt 11 similarly includes a bearing housing 92 at each end mounted on a beam 93 connected between the middle beams 86 of the E-frames 60 and 70.

The upper press roll 61 has its bearing housings 95 carried by arms 96 each of which has a pivotal mounting 97 on a bracket or clevice 99 on the upper beam 87 of the E-frame 60. The upper press roll 63 is mounted by similarly numbered parts on the opposite side of the same frame beam 87.

In order to provide for control of the pressure between the two rolls in each pair, a hydraulic cylinder 100 is connected between the bearing housings of the two rolls in each pair. In operation, these cylinders are operated to pull each of the upper rolls downward to increase the nip pressure through each pair of rolls. For purposes of wire changing, these cylinders can be reversed to raise the upper rolls out of engagement with the wire 65, and they can be held in raised positions by pins in the holes 101 in brackets 99 and matching holes in the arms 96. One end of each of the cylinders 100 is provided with a clevis or equivalent connection (not shown) to its associated bearing housing which is readily releasable to complete opening of the gap between the upper and lower parts of the press section.

Because in normal operation, the series of washing zones will not increase the consistency of the pulp mat 16 to more than about 15%, it may be desirable to provide a preliminary pressing station upstream from the rolls 62–63. As shown in FIG. 2, two rolls 102 and 103 of relatively small diameter have their opposite ends mounted on the beams 93 connected between the middle E-frame beams 86. An upper press roll 105 is supported at each end by an arm 106 pivotally mounted at 107 on the upper beam 87 of E-frame 70. Each of the arms 106 is in turn connected through an air bag 110 with a beam 111 mounted between the upper E-frame beams 87. By means of the air bag 100, the upper press roll 105 can be raised or lowered to vary the pressure exerted thereby on the pulp mat 106 between the rolls 102 and 103.

The beam 111 also supports the guide roll 66 and the opposite ends of a trough 112 positioned to receive wash water discharged through the wire 65 from a shower pipe 113 extending across the width of the apparatus. Similar shower pipes 115 can be used to wash the lower run of the wire belt 11 into the receptacle 75.

For preferred operating conditions, the hydraulic cylinders 199 controlling the pressure exerted on the mat 16 by the successive pairs of pressure rolls will be controlled to provide lower pressure between the rolls 62–63 and between the rolls 13 and 61. While this will avoid crushing of the mat, the more important result is that it will, in effect, provide for continuing the displacement dewatering of the mat in that the combination of pressure dewatering and gravity will cause the major part of the dewatering to take place in a downward direction, and thus to express through the wire 11 that portion of the liquid remaining in the mat which contains the highest quantity of liquor and other contaminants. In other words, this pressure dewatering following the displacement dewatering continues the downwardly directed gradient pattern of the dewatering established by the non-mechanical dewatering through the excessive washing zones 31–35.

Figure 4:
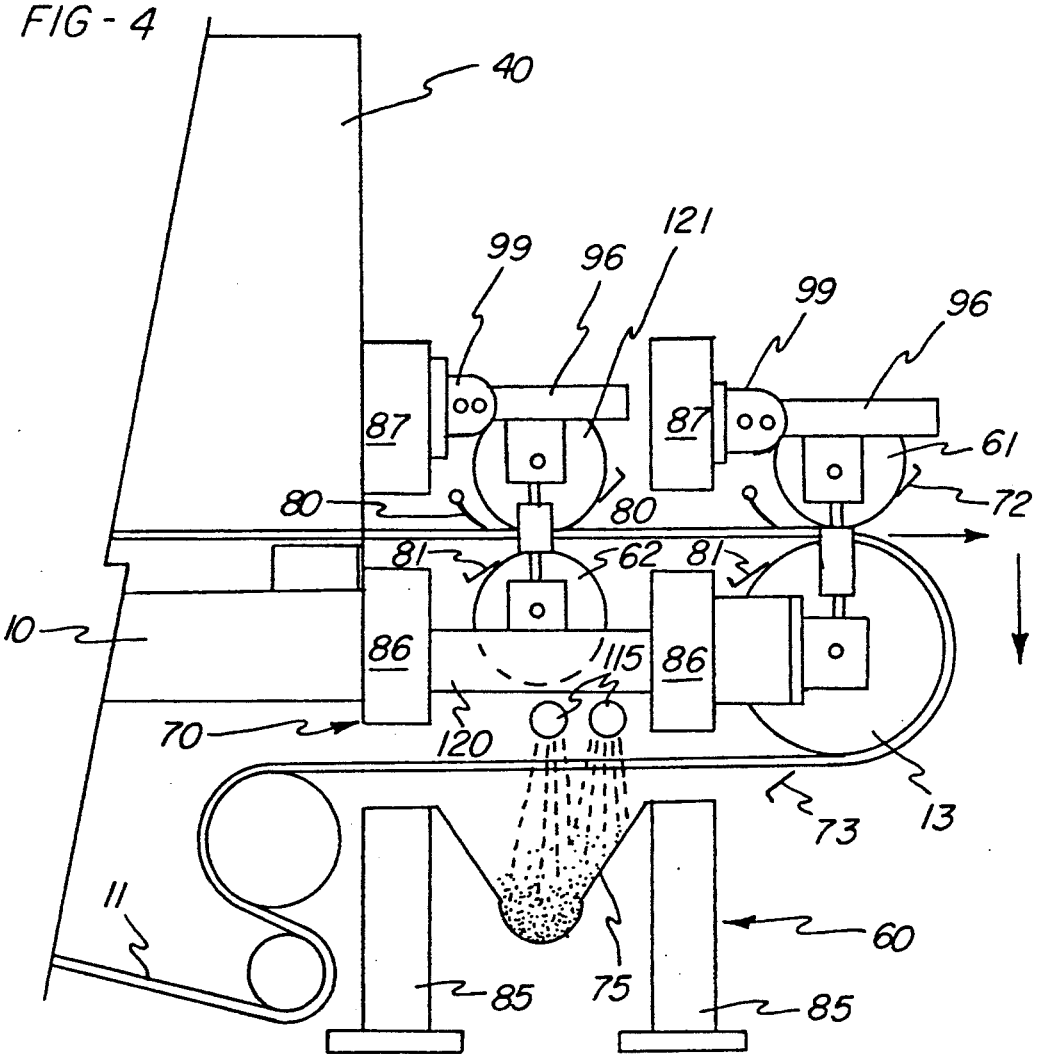
FIG. 4 is a view similar to FIG. 2 showing another form of pressing section embodying the invention.
Figure 5:
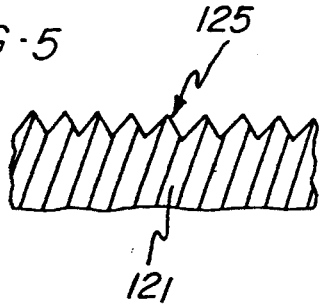
FIG. 5 is a fragmentary section on the line 5—5 in FIG. 4.

FIGS. 4 and 5 illustrate another construction in accordance with the invention which may be used in place of the construction shown in FIG. 2, and which does not require a second wire belt as in FIG. 2. In FIG. 4, the couch roll 13 is mounted in substantially the same way as shown in FIG. 2 on the middle beam 86 of the E-frame 60. The upper press roll 61 which cooperates with the couch roll 13 is similarly mounted on the upper beam 87 of the E-frame 60.

Figure 7:
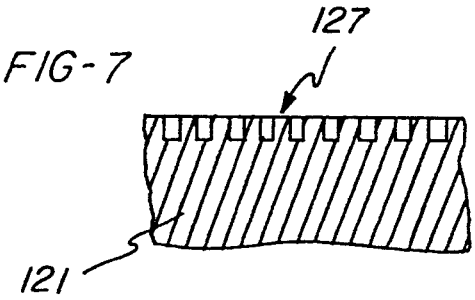
FIGS. 6–8 are views similar to FIG. 5 showing other modifications in accordance with the invention.
Figure 6:
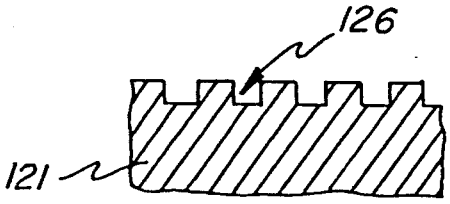
Figure 8:
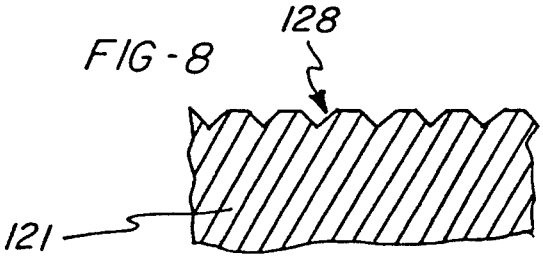

The press roll 61 inside the loop of belt 11 has its bearings mounted on beams 120 connected between the middle beams 81 of the E-frames 60 and 70. Its cooperating upper press roll 121 is provided with an outer surface 123 which is substantially less smooth than that of the wire belt 11 in order to minimize the possibility that any of the pulp passing under roll 121 will adhere thereto rather than remaining on the belt 11. For example, the surface of the roll 121 may be grooved as shown at 125 in FIG. 5 or at 126 in FIG. 6, or it may be provided with multiple drilled holes as shown at 127 in FIG. 7 or countersunk holes as shown at 128 in FIG. 8.

The operation of this form of the invention is essentially the same as with the pressing section described in connection with FIG. 2. Thus where in FIG. 2, the upper wire 65 prevents the pulp from adhering to the upper press roll 63, the same result is achieved by the roughened surface of the roll 121, because the pulp will naturally tend to remain on the smoother surface of the belt 11. The doctor blade 130 engaging the upwardly moving surface of the roll 121 may therefore be superfluous but can be provided to remove such scraps of pulp as might adhere to roll 121. Since the roll 61, however, has a smooth surface, the thickened pulp 16 will transfer thereto from the wire, and it can be scraped therefrom by a doctor blade 131 in the same manner as the doctor 72 in FIG. 2. Otherwise, the practical results achieved by the use of this form of the invention will be the same as described above in connection with FIG. 2.

It should also be noted that the pressing section shown in FIG. 4 can be augmented by a preliminary arrangement of rolls as previously described in connection with rolls 102, 103 and 105 in FIG. 2. The only adjustment needed to accommodate such an additional preliminary pressing station would be to increase the spacing between the frames 60 and 70 and the length of the beams 120. It might then also be advantageous to transfer the mounting of the roll 121 to the frame 60 rather than having it mounted on the frame 70 as shown in FIG. 4.

The effectiveness of the invention in washing pulp is readily apparent from consideration of one example in conjunction with the fact that, as noted above, the consistency of the washed pulp as produced on apparatus in accordance with the Ericsson patent will be normally about 15% or possibly less. In contrast, testing of apparatus in accordance with the invention is established that a discharge consistency of 40% is readily obtained. This means that during the pressing stage, more than 70% of the liquid remaining in the pulp as delivered to the pressing section will be expressed therefrom, along with the contaminant materials entrained in that liquid.

While the method herein described, and the forms of apparatus for carrying this method into effect, constitute preferred embodiments of this invention, it is to be understood that the invention is not limited to this precise method and forms of apparatus, and that changes may be made therein without departing from the scope of the invention, which is defined in the appended claims.

What is claimed is:

1. Apparatus for washing a suspension of cellulosic pulp in digesting liquor, comprising:

(a) a frame including means for supporting an endless foraminous belt in a loop including a substantially horizontal upper run with an upstream end and a downstream end, (b) means for driving said belt run in a single direction moving from said upstream end to said downstream end, (c) means for depositing the suspension on said upstream end of said belt run for drainage therethrough to form a mat of said particles on said run, (d) means including a plurality of drainage receptacles below and in sealed relation with said belt run which define a corresponding plurality of zones along said run including a formation zone at said upstream end thereof and a plurality of successive washing zones between said formation zone and said downstream end, (e) means for alternately flooding and dewatering said mat during passage thereof through each of said zones including means for maintaining a lower pressure in the interior of each of said receptacles than in the space directly above said belt to cause liquid to drain from said mat through said belt run into said receptacles, (f) said flooding and dewatering means also including means for delivering liquid to each of said washing zones from above said upper run for displacement washing of the portion of said mat passing therethrough and drainage into said receptacles, (g) means for supplying fresh washing liquid to said delivering means for the final one of said washing zones closest to said downstream end of said belt run, (h) means for conveying drained liquid from each of said receptacles countercurrently with respect to the direction of movement of said belt to said delivering means for the adjacent said washing zone upstream from said receptacle, (i) adjacent said washing zones being contiguous whereby said mat is maintained free of mechanical pressure during passage thereof from said upstream end of said belt run through said final washing zone, (j) roll means downstream from said final washing zone including two rolls within said belt loop, (k) said roll means including a couch roll at said downstream end of said belt run, (l) the other of said rolls being spaced between said couch roll and said final washing zone, (m) first and second upper rolls above said belt run and in pressure nip forming engagement with said couch roll and said other roll respectively for subjecting said mat to a plurality of pressing operations for compacting said mat while expressing liquid therefrom through said belt, (n) means for causing the resulting compacted mat to travel upwardly around said first upper roll from said belt and the nip formed by said first upper roll and said couch roll, comprising a second belt loop enclosing said first and second upper rolls, said second belt loop having a finer mesh than said foraminous belt to cause said pulp mat to adhere thereto and travel upwardly thereon as said pulp mat travels from said nip, and (o) means for removing said upwardly moving pulp mat from said said belt loop.

2. Washing apparatus as defined in claim 1 further comprising means for causing controlled adjustable pressure engagement between each of said upper rolls and said roll means in engagement therewith.

3. Washing apparatus as defined in claim 1 wherein said frame further comprises bearing housings supporting said rolls within said belt loop with the axes thereof substantially fixed, and controlled pressure applying means supporting each said upper rolls above and in controlled adjustable pressure engagement with said roll means.

4. Washing apparatus as defined in claim 1 wherein each of said rolls is supported at the ends thereof in bearing housings, and said bearing housings of said upper rolls are connected with said bearing housings of said roll means by fluid pressure cylinders for controlling the pressure between said rolls in each said pair.

5. Washing apparatus as defined in claim 1 wherein said roll means define two separate pressing stages, and further comprising means for regulating the pressures applied to said mat in each of said stages to apply greater such pressure in the more downstream said stage than in the preceding said stage.

6. Washing apparatus as defined in claim 1 further comprising means positioned above said belt and closely adjacent the upstream side of at least the nip defined by said other roll and said second upper roll for collecting and delivering to one side of said apparatus liquid expressed upwardly from said mat in passing through said nip.

7. Apparatus for washing a suspension of cellulosic pulp in digesting liquor, comprising:

(a) a frame including means for supporting an endless foraminous belt in a loop including a substantially horizontal upper run with an upstream end and a downstream end, (b) means for driving said belt run in a single direction moving from said upstream end to said downstream end, (c) means for depositing the suspension on said upstream end of said belt run for drainage therethrough to form a mat of said particles on said run, (d) means including a plurality of drainage receptacles below and in sealed relation with said belt run which define a corresponding plurality of zones along said run including a formation zone at said upstream end thereof and a plurality of successive washing zones between said formation zone and said downstream end, (e) means for alternately flooding and dewatering said mat during passage thereof through each of said zones including means for maintaining a lower pressure in the interior of each of said receptacles than in the space directly above said belt to cause liquid to drain from said mat through said belt run into said receptacles, (f) said flooding and dewatering means also including means for delivering liquid to each of said washing zones from above said upper run for displacement washing of the portion of said mat passing therethrough and drainage into said receptacles, (g) means for supplying fresh washing liquid to said delivering means for the final one of said washing zones closest to said downstream end of said belt run, (h) means for conveying drained liquid from each of said receptacles countercurrently with respect to the direction of movement of said belt to said delivering means for the adjacent said washing zone upstream from said receptacle, (i) adjacent said washing zones being contiguous whereby said mat is maintained free of mechanical pressure during passage thereof from said upstream end of said belt run through said final washing zone, (j) roll means downstream from said final washing zone including two rolls within said belt loop, (k) said roll means including a couch roll at said downstream end of said belt run, (l) the other of said rolls being spaced between said couch roll and said final washing zone, (m) first and second upper rolls above said belt run and in pressure nip forming engagement with said couch roll and said other roll respectively for subjecting said mat to a plurality of pressing operations for compacting said mat while expressing liquid therefrom through said belt, (n) means for causing the resulting compacted mat to travel upwardly around said first upper roll from said belt and the nip formed by said first upper roll and said couch roll, further comprising means forming a discontinuous surface of said second upper roll, said first upper roll having a smooth surface to cause said compacted mat to adhere thereto and travel upwardly thereon as said mat travels out of said nip, and doctor means for removing said transferred mat from the portion of the surface of said smooth surfaced upper roll which is moving upwardly from the nip of said roll with said couch roll.

8. Washing apparatus as defined in claim 7 wherein said discontinuous surface on said second upper roll comprises multiple circumferentially extending grooves.

* * * * *